US010228108B2

(12) United States Patent
Courcier et al.

(10) Patent No.: US 10,228,108 B2
(45) Date of Patent: Mar. 12, 2019

(54) PRIMARY OPTICAL ELEMENT FOR MOTOR VEHICLE LIGHTING MODULE

(71) Applicant: Valeo Vision, Bobigny (FR)

(72) Inventors: Marine Sebastien Courcier, Paris (FR); Vanesa Sanchez, Bois Colombes (FR); Kostadin Beev, Emerainville (FR)

(73) Assignee: VALEO VISION, Bobigny (FR)

( * ) Notice: Subject to any disclaimer, the term of this patent is extended or adjusted under 35 U.S.C. 154(b) by 133 days.

(21) Appl. No.: 15/272,997

(22) Filed: Sep. 22, 2016

(65) Prior Publication Data

US 2017/0089536 A1 Mar. 30, 2017

(30) Foreign Application Priority Data

Sep. 28, 2015 (FR) ..... 15 59101

(51) Int. Cl.

| | |
|---|---|
| ***F21S 41/143*** | (2018.01) |
| ***F21S 41/20*** | (2018.01) |
| ***F21S 41/24*** | (2018.01) |
| ***F21S 41/265*** | (2018.01) |
| ***F21S 41/27*** | (2018.01) |

(Continued)

(52) U.S. Cl.

CPC ..... *F21S 41/143* (2018.01); *F21S 41/20* (2018.01); *F21S 41/24* (2018.01); *F21S 41/265* (2018.01); *F21S 41/27* (2018.01); *F21S 41/663* (2018.01); *F21W 2102/00* (2018.01)

(58) Field of Classification Search

CPC ..... F21S 41/663; F21S 41/265; F21S 41/27; F21S 41/143; F21S 41/20; F21S 43/00; F21S 43/15; F21S 41/255; F21S 41/26; F21S 41/32; F21S 41/141; F21S 41/00; F21W 2102/00; B60Q 1/04; G02B 27/0025; Y10S 362/80; F21Y 2115/10

See application file for complete search history.

(56) References Cited

U.S. PATENT DOCUMENTS 5,697,690 A * 12/1997 Okuchi ..... B60Q 1/0011 362/551
8,408,721 B2 4/2013 Auerbach et al.
(Continued)

FOREIGN PATENT DOCUMENTS

EP 2280215 A2 2/2011
EP 2306073 A2 4/2011
(Continued)

*Primary Examiner* — Anh T Mai
*Assistant Examiner* — Fatima N Farokhrooz
(74) *Attorney, Agent, or Firm* — Oblon, McClelland, Maier & Neustadt, L.L.P.

(57) ABSTRACT

A primary optical element for a motor vehicle lighting module that comprises a light introduction part provided with a plurality of primary optical means connected at output to a correcting part, the primary optical means being arranged on at least two levels in a first direction, as first and second distinct primary optical means. A plurality of first primary optical means are arranged in series in a second direction substantially perpendicular to the first direction. In one embodiment, a lighting module is disclosed for a motor vehicle headlight which comprises a plurality of light sources, such a primary optical element and an associated secondary optical element.

15 Claims, 2 Drawing Sheets

(51) Int. Cl.
*F21S 41/663* (2018.01)
*F21W 102/00* (2018.01)

(56) References Cited

U.S. PATENT DOCUMENTS

| | | | | |
|---|---|---|---|---|
| 2006/0028829 | A1* | 2/2006 | Amano | G02B 3/0037 362/505 |
| 2008/0130309 | A1* | 6/2008 | Condon | B60Q 1/34 362/520 |
| 2008/0239435 | A1* | 10/2008 | Song | H04N 9/3129 359/204.1 |
| 2011/0141442 | A1 | 6/2011 | Auerbach et al. | |
| 2014/0043843 | A1* | 2/2014 | Moser | F21S 41/141 362/545 |
| 2014/0307459 | A1* | 10/2014 | Brendle | F21S 41/143 362/520 |
| 2015/0131305 | A1* | 5/2015 | Courcier | F21S 48/1225 362/516 |

FOREIGN PATENT DOCUMENTS

| | | | |
|---|---|---|---|
| EP | 2306074 | A2 | 4/2011 |
| EP | 2743567 | A1 | 6/2014 |
| EP | 2871406 | A1 | 5/2015 |
| FR | 2999679 | A1 | 6/2014 |

* cited by examiner

PRIMARY OPTICAL ELEMENT FOR MOTOR VEHICLE LIGHTING MODULE

CROSS-REFERENCE TO RELATED APPLICATIONS

This application claims priority to the French application 1559101, filed Sep. 28, 2015, which application is incorporated herein by reference and made a part hereof.

BACKGROUND OF THE INVENTION

1. Field of the Invention

The invention relates to the field of lighting and/or signaling, notably for motor vehicles. It relates more particularly to a headlight lighting module and to an associated primary optical element within this module.

2. Description of the Related Art

A motor vehicle is fitted with headlights, or headlamps, which are intended to illuminate the road ahead of the vehicle, by night or under conditions of low lighting, using an overall beam of light. These headlights, a left headlight and a right headlight, comprise one or more lighting modules designed to generate and direct an intermediate beam of light which together form the overall beam of light.

These headlights can generally be used in two lighting modes: a first "high-beam" mode producing a high beam and a second "low-beam" mode producing a low beam. The "high-beam" mode allows the road to be illuminated strongly a great distance ahead of the vehicle. The "low-beam" mode produces a more limited lighting of the road, which nevertheless offers good visibility, without dazzling other road users. The two lighting modes, "high-beam" and "low-beam" complement one another, the transition from one to the other being made according to the traffic conditions. It is known practice to create the high-beam beam by adding the low-beam beam to an additional beam, that joins onto the low-beam beam at the cutoff. The low beam is generated by illuminating only means specific to the second, "low-beam" mode, while the high beam is generated by simultaneously illuminating means specific to the second "low-beam" mode and means specific to the first, "high-beam" mode.

There is now a need, within the automotive sector, to be able to illuminate the road ahead in a "partial full-beam mode", namely to be able to generate, within a "high-beam" beam, one or more dark regions corresponding to the places in which oncoming vehicles or vehicles driving in front are present, so as to avoid dazzling the drivers of these vehicles which at the same time illuminating the roadway over the greatest possible area. Such a function is referred to as ADB (Adaptive Driving Beam) or alternatively as "selective beam". Such an ADB function consists in, on the one hand, automatically detecting a road user liable to be dazzled by a beam of light emitted in high-beam mode by a headlight and, on the other hand, automatically modifying the shape of this beam of light so as to create a dark zone at the place where the detected user is located, with no manual intervention on the part of the driver of the vehicle. The ADB function has many advantages: ease of use, better visibility as compared with illumination in low-beam mode, better reliability in the change of mode, greatly reduced risk of dazzling, safer driving.

Lighting modules, in which, in order to create a selective beam, optical guides are placed side by side, each one illuminated by a respective light source so that the beam of light exiting the module is broken down into contiguous regions that can be switched off or on according to instructions pertaining to the detection of a nearby vehicle, are known.

The shape and arrangement of the guides relative to one another in a headlight module need to be very precise in order on the one hand to be able to create an intermediate beam exiting the module which is uniform and smoothed when all the segments are illuminated, and in order on the other hand to be able to offer an intermediate beam that complements the intermediate beam produced at output from the other headlight. In document FR 2 999 679, the Applicant company has disclosed a monoblock primary optical element that can be incorporated into a lighting module further comprising a projection system, the primary optical element comprising guides formed as integral parts of a planar face arranged in a ball the opposite face of which is substantially spherical, the ball notably forming a correction portion that makes it possible to improve the optical efficiency of the system and to correct aberrations of the lighting module.

SUMMARY OF THE INVENTION

The present invention falls within a context of optimizing these matrix lights and within the context of increasing the number of lighting functions that can be offered to users, these including, by way of example, the high-speed or motorway lighting function (the function known as the "Motorway Light" function), in which the intensity of the beam is increased around the optical axis of the headlight in order to increase the range of illumination, or alternatively the adverse weather function (the function referred to as the AWL function which stands for "Adverse Weather Light"), in which the low-beam beam is directed in such a way that the reflection of headlight light off the wet road surface does not dazzle. Furthermore, it is increasingly frequent to see motor vehicles equipped with a directional lighting function, better known by its abbreviation DBL (which stands for Dynamic Bending Light), in which the objective is to illuminate bends dynamically as the vehicle turns. For this purpose, it is known practice to mount the lighting module with the ability to pivot about a substantially vertical axis of rotation so that in a bend, the beam projected at output from the headlight is no longer oriented along the longitudinal axis of the vehicle but toward the inside of the bend.

It will be appreciated that it is advantageous for the increase in the number of such functions to be accompanied by a target of reducing the number of modules in a headlight, in order to optimize its size, and/or of reducing the number of components in each one of these modules.

The invention falls within this context and seeks to propose a primary optical element for a motor vehicle lighting module, comprising a light introduction part provided with a plurality of primary optical means connected at output to a correcting part, the primary optical means being arranged on at least two levels in a first direction, in this instance a vertical direction, as first and second distinct primary optical means, a plurality of first primary optical means being arranged in series in a second direction in this instance a transverse direction, substantially perpendicular to the first direction.

Thus, there are two distinct series of primary optical means, which can be used with series of light sources that are independent of one another and which are both connected to a common correcting optical element, making it easier to project distinct beams of light in a single lighting module. The series are notably distinct insofar as the input faces of the first primary optical means have a profile that is distinct from the profile of the input face of the second primary optical means.

According to one series of features, which may be considered alone or in combination, suited to the configuring of the various primary optical means, provision may be made for:

- the primary optical means to have an output face connected to the correcting part and a light input face facing away from this correcting part;
- illumination of the second primary light sources to create a low beam and illuminating all of the primary light sources, the first ones and the second ones, to create a high beam, with an upper part liable to dazzle users on the road scene, which is a matrix-type arrangement with contiguous regions, for example segments, that can be selectively switched off in order to avoid this dazzling;
- the second primary optical means to consist of a strip of material extending continuously in the second direction, overhanging the first primary optical means; by "continuously" it is meant that the input face of the second primary optical means may have a profile that varies from one transverse end of this second primary optical means to the other. It may be noted that the concept of continuity can be explained by the fact that, unlike the first primary optical means, there is a tendency to remain within the material when passing transversely from one end of the second primary optical means to the other. In other words, if the second primary optical means overhanging the first primary optical means is likened to a succession of second primary optical means in a second direction, in this instance a transverse direction, each second primary optical means can be considered to comprise a junction part making the junction with the correcting part and an optical profile installed on the junction part, the junction parts of the second primary optical means forming a common junction part extending continuously in the second direction.
- the input face of the primary optical means to have a plurality of convex shapes: these convex shapes may notably be defined by shapes that have lateral ends contiguous with the adjacent convex shapes and a central part between these lateral ends which is domed, diverging away from the correcting part;
- the output faces of the primary optical means to be offset axially, along an optical axis substantially perpendicular to the first and second directions, with respect to the output faces of the second primary optical means;
- the first and second primary optical means to be arranged, on each side of the optical axis of the module; provision may notably be made for the junction between these first and second means to pass through this optical axis;
- the output face of the second primary optical means to be set back axially, with respect to the correcting part, with respect to the output faces of the first primary optical means.

According to another series of features, which may be considered alone or in combination, suited this time to the configuring of the correcting part, provision may be made for:

- the correcting part to comprise an output face at least partially in the shape of a substantially spherical dome: it will be noted that "substantially spherical dome" is intended to imply a surface the shape of which at least partially conforms to that of a sphere and that, in other words, the correcting part is delimited by at least one output face having at least one spherical portion;
- the output face in the shape of a substantially spherical dome to be centered substantially at the exit of one of the first primary optical means;
- the output face in the shape of a substantially spherical dome to be centered substantially between the first primary optical means and the second primary optical means;
- the input face of the corrector to be able to be planar or alternatively to be inscribed within a curved profile notably following the focal surface of a secondary optical element;
- the correcting part to be able also to adopt a partial ball shape and possibly the shape of a truncated ball portion, which means to say one cut off on each side of the spherical portion formed on the output face.

The correcting part as has just been described makes it possible to improve the optical efficiency of the lighting module and also makes it possible to correct aberrations of field of the optical system and thus ensure high-quality imaging.

The primary optical element according to the invention is advantageously monoblock. At least the first primary optical means and the correcting part form an assembly that cannot be dismantled without causing damage to one or the other. Furthermore, the second primary optical means may form a monoblock structure with the correcting part and the first primary optical means. In order to obtain such a monoblock arrangement, all of the components that make up this primary optical element may be produced as a single part, notably by molding, or alternatively, one of these components, for example the secondary optical means, may be attached on. It is notable that, in order to facilitate the transmission of rays of light across the introduction part and the correcting part, and not generate any deviation of the rays as they pass from one to the other, the respective refractive indices of the primary optical means and of the correcting part may be substantially identical. Further, in this context and with the additional advantage of making the monoblock structure easier to obtain, notably by molding, the primary optical means and the correcting part may be made from the same material, and may be derived from the same polymer.

According to features of the invention, considered alone or in combination with one another and with the features mentioned hereinabove:

- at least one, and notably each, first primary optical means is intended to receive a first primary beam of light from a light source positioned facing its light input face and is designed to shape this first primary beam of light so that the projection of this first primary beam of light onto the road exhibits the form of a vertical strip of light having a lower edge, and notably having vertical edges which are sharp;
- at least one first primary optical means comprises a face, an upper or a lower face, in the shape of a cylindrical portion;
- the input face of at least one primary optical means extends at least partially in a plane that is inclined with respect to the plane in which the rear face of the correcting part extends by an angle of between 0° and 45;
- at least one first primary optical means comprises at least one spreading face, the spreading face being configured in such a way as to broaden the cross section of the primary optical means from its input face to its exit;

the first primary optical means and the associated first primary light sources arranged facing the input face are configured so that the rays emitted by these light sources enter the corresponding first primary optical means via the rear face and then travel along inside this first primary optical means toward the output face, possibly by successive total internal reflection off the lower, upper and lateral faces;

the cross section of each first primary optical means may have a parallelogram, and more specifically a rectangular, overall shape;

the first primary optical means are juxtaposed and form, arranged at regular intervals, a horizontal row such that the secondary light sources are virtually arranged in series on the rear face of the correcting part, substantially over the objective focal surface of the projection system, so as to be projected to infinity in this segmented arrangement;

the upper face of each of the first primary optical means may be a curved surface having the overall shape of a portion of a cylinder of substantially ellipsoidal generatrix, this notably having the effect of concentrating the intensity of light in the top part of the beam exiting the first primary optical means, which corresponds to a zone (referred to as "range zone") situated in the bottom of the matrix beam produced at output from the light module and which corresponds to the cutoff zone at the junction with the low beam produced at output from the optical module through the interaction of the second primary light sources and of the associated second primary optical means.

Provision may, according to the invention, be made for the or each second primary optical means to be intended to receive a second primary beam of light from a second primary light source positioned facing its light input face and for it to be arranged in such a way as to shape this second primary beam of light in such a way that the projection of this second primary beam of light onto the roadway has an upper cutoff. If appropriate, the second primary optical means may be arranged in such a way that the upper cutoff is a flat cutoff or, as an alternative has at least one oblique cutoff portion.

According to various features specific to this second primary optical means, provision may be made for:

the lower face of the second primary optical means to be able to be a curved surface having the overall shape of a cylindrical portion, this having the effect of concentrating the light intensity in the bottom part of the beam exiting the second primary optical means, this corresponding to a region situated as close as possible to the cutoff on exit from the lighting module; the lower face may notably be arranged substantially in a mirror arrangement with respect to the upper face of the first primary optical means;

these mutually opposing surfaces respectively act as a total reflection intensifier, which means to say serve to concentrate the projected beam of light exiting the corresponding primary optical means;

the first and second primary optical means adjoin, at their output face, being joined at an edge the profile of which is that of the desired cutoff for the low beam which is generated by the second primary optical means.

The primary optical means may adopt different forms without departing from the scope of the invention, provided they comply with the stepped arrangement of two distinct series, which incidentally may adopt distinct shapes from one series to the other. In particular, these primary optical means may consist of light guides or alternatively may take the form of microlenses, bushings or even collimators.

Furthermore, it is possible to envision having just one single second primary optical means, notably for creating a static low beam, or alternatively to have a plurality of second primary optical means, notably for creating a dynamic low beam for adaptive bending light for example, or in the context of a motorway function.

Another subject of the invention is an optical assembly comprising the primary optical element as described hereinabove, and a plurality of primary light sources, a first primary light source being associated respectively with each of the primary optical means in series, whereas one second primary source is associated with each of the convex shapes, or each of the optical profiles of the second primary optical means.

In such an optical assembly it is possible to make provision for the primary light sources to be mounted on a support extending both facing the first primary optical means and facing the second primary optical means. Further, it is possible to envision the support not being planar but potentially having an inclined shape so that it can face light guides which are not necessarily placed in one and the same vertical plane.

The invention further relates to a lighting module for a motor vehicle headlamp, which comprises a plurality of primary light sources, a primary optical element as mentioned hereinabove and an associated secondary optical element. The various primary optical means of the primary optical element may be arranged on the primary optical element in such a way that the outputs of the primary optical means are positioned near an objective focal surface of a projection system formed by the primary optical element and the secondary optical element while the output from the primary optical means is offset longitudinally with respect to this objective focal surface. It is thus possible, using one and the same primary optical element, to create, on the one hand, using light sources and the series of separate primary optical means, a segmented high beam which is a sharp image of the segmented arrangement of the guide outputs on the correcting part of the primary optical element and, on the other hand, using light sources and the continuous primary optical means, a low beam that is rendered horizontally homogeneous, the vertical focus being maintained in order to create a sharp horizontal cutoff (e.g. of the low beam type).

According to the invention, provision is made for the distance between the primary optical element and the secondary optical element to be strictly greater than zero.

It is thus possible to create patterns of the "modulations" or "microstructures" type on the surfaces of the secondary optical element 4 in order deliberately to introduce controlled fuzziness into the cutoff.

A lighting module according to the invention, in which a primary optical element bears stepped primary optical means able to face distinct primary light source series, makes it possible, with a single means, to perform a plurality of optical functions, notably including a so-called DBL (Dynamic Bending Light) function or a so-called AWL (Adverse Weather Light) function. One and/or other of these functions can notably be performed in a straightforward manner by modulating the intensity of light emitted by the primary light sources facing the primary optical means.

The invention also relates to a motor vehicle headlight comprising at least one lighting module as has just been introduced.

These and other objects and advantages of the invention will be apparent from the following description, the accompanying drawings and the appended claims.

BRIEF DESCRIPTION OF THE ACCOMPANYING DRAWINGS

Further features and advantages of the present invention will become more clearly apparent from the description and the drawings among which:

FIGS. 3 and 4 depict a beam of light that is at least partially segmented, FIG. 3 depicting the beam produced by a single optical assembly as illustrated in FIG. 1 whereas FIG. 4 depicts the beams produced by two optical assemblies arranged relative to one another in such a way that the respective beams become superposed;

Figure 1:
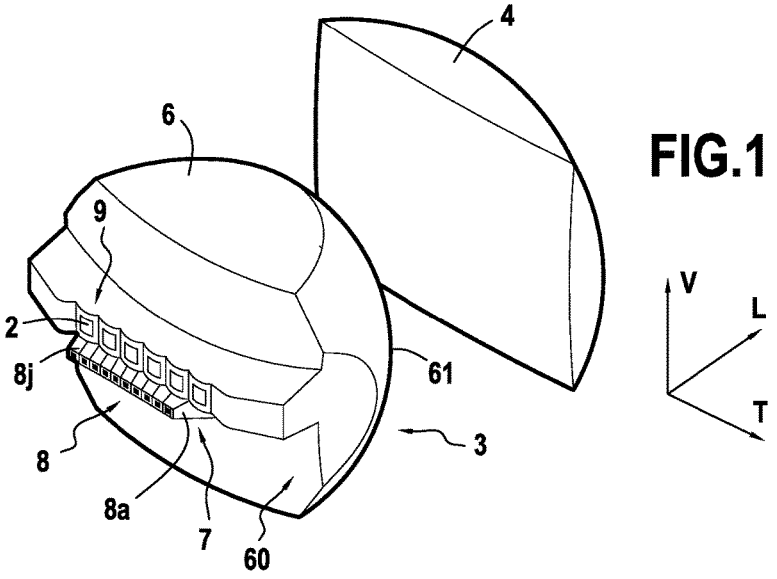
FIG. 1 is a perspective illustration of a primary optical element and of a secondary optical element of an optical assembly for a lighting module according to a first embodiment of the invention.
Figure 6:
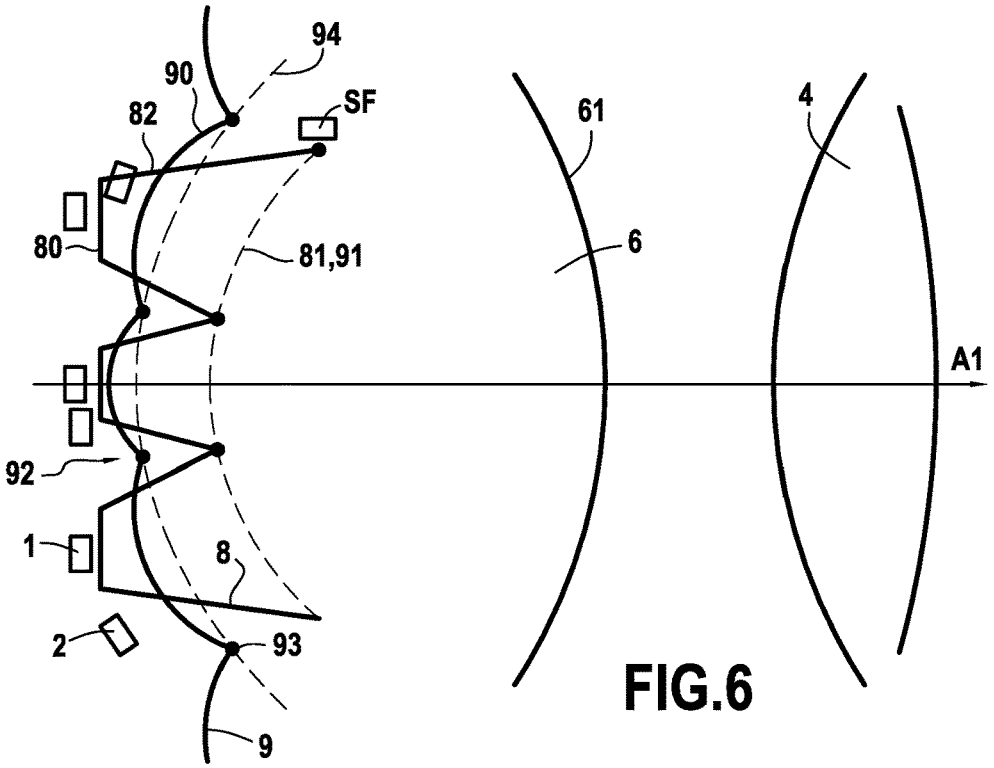
Figure 5:
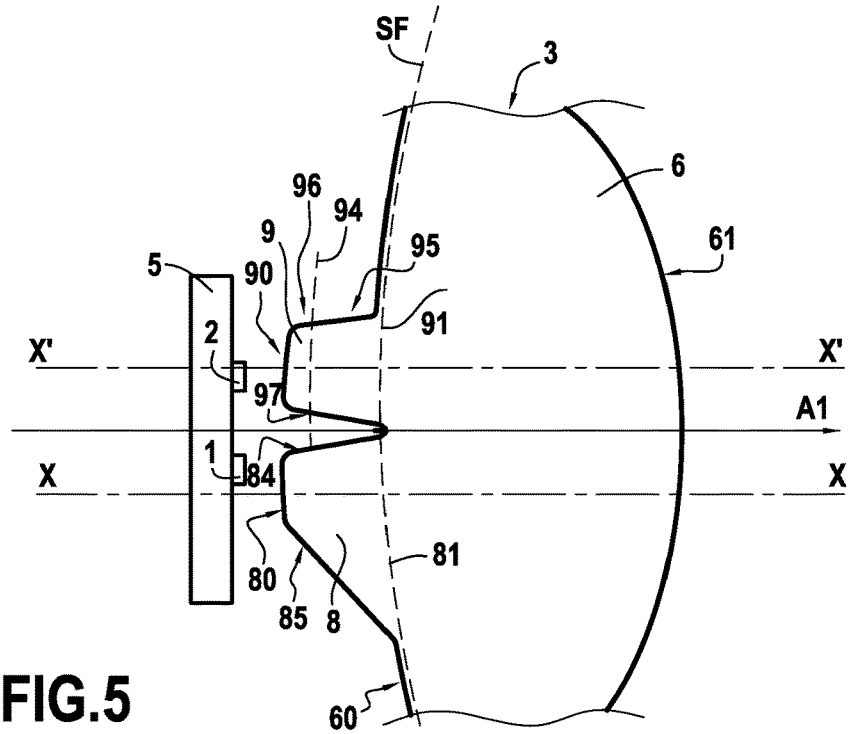

FIG. 5 is a view in vertical section of the optical assembly illustrated in FIG. 1, in which the secondary optical element is not visible; and FIG. 6 is a superposition of two views in horizontal section, one on the axis X-X depicted in FIG. 5 and illustrating the cross section of the first light guides of the primary optical element, and the other on the axis X'-X', also depicted in FIG. 5, and illustrating the cross section of second light guides.

DETAILED DESCRIPTION OF THE PREFERRED EMBODIMENTS

In the description which will follow, reference will be made to the orientation given arbitrarily on the basis of the trihedron L,V,T illustrated in FIG. 1 and indicative of the representative Longitudinal, Vertical, Transverse directions.

The lighting module comprises a plurality of primary light sources arranged in two distinct series superposed in a first direction, in this instance vertically one above the other, a series of first primary light sources 1 (visible notably in FIG. 2) here being arranged underneath a series of second primary light sources 2. The module further comprises a primary optical element 3 and a secondary optical element 4 for projection, having an optical axis $A_1$ (FIG. 6).

By definition, the front and rear of the module are defined by the direction of the arrow indicative of the longitudinal direction of the L,V,T trihedron in FIG. 1.

The first and second primary light sources 1 (FIG. 2) and 2 are, in the particular example described here, light emitting diodes or LEDs. However, the light emitting diodes could be replaced by other light sources without departing from the scope of the invention. These first and second primary light sources 1 and 2 are borne by one and the same support 5 (visible in FIG. 5), thereby making it possible to limit the number of components in the lighting module.

The primary optical element 3 comprises a correcting part 6 and a light introduction part 7 by means of which the rays of light emitted by the first and second primary light sources 1 and 2 enter the primary optical element in order thereafter to be conveyed into the correcting part. The light introduction part 7 has a stepped arrangement, which means to say an arrangement one above the other in the first direction, in this instance the vertical direction, of, on the one hand, a plurality of first primary optical means 8, in this instance light guides, also known as waveguides or optical guides, respectively associated with the first primary light sources 1, and, on the other hand, a second primary optical means 9, in this instance a single light guide forming a strip of material extending in a second direction, in this instance a transverse direction, continuously and lying overhanging the first primary optical means 8 and of which a rear face 90 (FIGS. 5 and 6), opposite to the correcting part 6, is positioned facing the second primary light sources 2.

According to the invention, two types of primary optical means are connected to one and the same correcting part 6 that transmits light toward the secondary optical element 4.

A first type consists of a plurality of first primary optical means 8, substantially separated from one another and arranged in series in the transverse second direction, whereas the second type consists of a single second primary optical means 9 formed by a strip of material extending substantially along the entire length of the series of the first primary optical means 8. The separate nature of the first primary optical means 8 and the continuous nature of the second primary optical means 9 can be distinguished through the fact that two contiguous first primary optical means 8 are spaced apart from one another over at least half of their longitudinal dimension. The fact that they are substantially separated from one another extends to junctions of primary optical means with machining and/or injection molding fillet radii due to the constraints on the methods used to create the primary optical element 3.

It is advantageous for at least one of the two types of primary optical means to form, with the correcting part 6, a monoblock structure. What is meant by a "monoblock structure" is that the elements of the structure cannot be separated from one another without destroying at least one of the elements. In the example illustrated in FIG. 1, provision has been made for the first primary optical means 8 in series to be formed as an integral part of the correcting part 6 and for the second primary optical means 9 to be attached on to the rear face 60 of the correcting part 6 and then integrated therewith, but it will be appreciated that the light introduction part 7 in its entirety (in this instance with the first primary optical means 8 in series and the second primary optical means 9 in strip form) could be formed as an integral part in order to form a monoblock structure with the correcting part 6.

The first and second primary optical means 8 and 9 are positioned on each side of the optical axis $A_1$ of the module, and the junction between these first and second primary optical means 8 and 9 may, as can be seen in FIG. 5, pass through this optical axis $A_1$.

It will be appreciated that, while in the embodiment illustrated the first and second primary optical means 8, 9 consist of light guides, these first and second primary optical means 8, 9 may, notably in the part allowing the generation of a low beam, consist of microlenses, bushings or collimators. In the latter instance in particular, it is possible to provide axisymmetric collimators or alternatively horizontal collimators, which means to say collimators which horizontally have a collimator profile that has been extruded along a vertical curve. The first and second primary optical means 8, 9 will be referred to hereinafter as a light guide.

The correcting part 6 is a portion of a sphere, or a portion of a ball, centered on the output of one of the first light guides 8. More specifically, in the particular example of FIG. 1, the correcting part 6 is a half-ball the center of which is situated in the output plane of this first light guide 8 and on the optical axis $A_1$ (FIG. 6). As an alternative, the output plane of this first light guide 8 could be substantially offset with respect to the center of the sphere by a distance less than or equal to 10% of the value of the radius of the sphere, preferably along the optical axis $A_1$. The front surface of the correcting part 6, notably in the shape of a spherical dome or spherical portion, constitutes an output front face 61 facing toward the secondary optical element 4. The rear face 60 of the correcting part 6 in this instance extends in the plane of section of the hemisphere. It could, however, have any shape, with the proviso that it perform the connection with the outputs of the first light guides 8 and the output of the strip of material that forms the second light guide 9 and that it does not alter the path taken by the rays emanating from the output ends of the first and second light guides 8 and 9 and spreading into the correcting part 6.

The projection system formed by the correcting part 6 and the output front face 61 thereof and by the secondary optical element 4 for projection defines an objective focal surface SF, visible notably in FIGS. 5 and 6.

As will be described in greater detail hereinafter, the shape of the rear face 60 of the correcting part 6 may be defined so that the output surface of a first type of guide is positioned substantially on the objective focal surface of the projection system formed by the correcting part 6 and by the secondary optical element 4 and so that the output surface of the second type of guide is offset longitudinally, which means to say axially, along the optical axis $A_1$, with respect to the objective focal surface.

In the embodiment illustrated, the correcting part 6 has the shape of half a ball or of a hemisphere defined by the rear face 60 of the correcting part 6 forming the plane of section and by the output front face 61 which is substantially spherical. Other embodiments are conceivable.

By way of example, the correcting part 6 may be a truncated ball portion, which means to say one cutoff on each side of the spherical portion formed on the output front face 61. Again, the correcting part 6 may take the form of a slightly deformed half-ball, notably with ball portions extending along a progressive radius of curvature until they reach the rear face 60 of the correcting part 6.

In each of these alternative forms of shape, it is notable that the light introduction part 7 and the correcting part 6 are manufactured from the same material and have the same refractive index. Having the "same refractive index" is intended to mean that the refractive index of the light introduction part 7 and that of the correcting part 6 are equal to within the nearest hundredth. "Same material" is intended to mean that the correcting part 6 and the light introduction part 7, and within this the first light guides 8 separated from one another and the second light guide 9 which is a single guide in the form of a strip, are made from the same material or derived from the same polymer. If they are derived from the same polymer, the first and second light guides 8 and 9 may have a different filler than that of the correcting part 6. By way of illustrative example, the first and second light guides 8 and 9 may be manufactured from PMMA-HT (Polymethyl MethAcrylate—High Temperature) with a refractive index of 1.490 and which is resistant to high temperatures, and the correcting part 6 may be made of PMMA-8N which has a refractive index of 1.491 and is less expensive.

Provision may also be made for the first and second light guides 8 and 9 to have different filler, it being understood that it is appropriate to ensure that the first light guides 8, which are individually associated with the first primary light source 1, are resistant to high temperatures.

The material of which the correcting part 6 on the one hand, and the first light guides 8 and the second light guide 9 in the form of a strip that forms the light introduction part 7 on the other hand are made is transparent. This is a material for optical lenses, such as an organic material or possibly glass.

Figure 2:
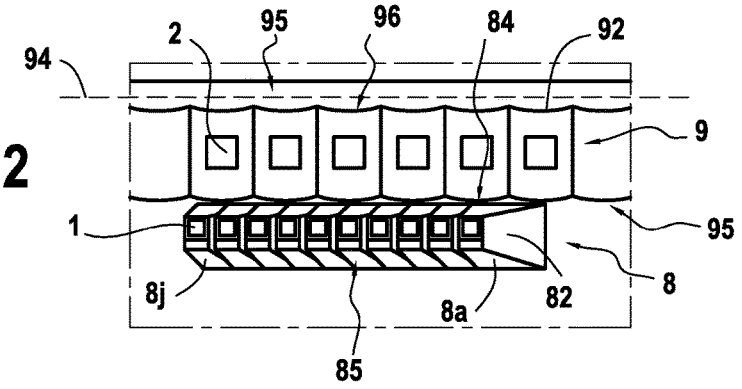
FIG. 2 is a detailed view of a primary optical element and of a plurality of primary optical means, in the form of light guides, secured thereto.

Reference will be made more particularly to FIGS. 1 and 2 for a more detailed and, initially, individual, description of the first and second light guides 8 and 9.

Each first light guide 8 extends along a longitudinal axis and each of its longitudinal ends comprises a rear face 80 for the light to enter, positioned facing one of the first primary light sources 1, and a front output, or output end or output interface, 81, acting as a secondary light source and connected to the correcting part 6. It also comprises, to connect its two longitudinal end faces, two lateral faces 82, an upper face 84 and a lower face 85.

For each pair formed of a first primary light source 1 and of an associated first light guide 8, the distance between an output plane of the first primary light source 1 and the input face of the associated first light guide 8 is between 0.1 millimeter and 1 millimeter.

The first light guides 8 and the first primary light sources 1 which are associated, and positioned facing the input face, are configured so that the rays emitted by these first primary light sources 1 enter the corresponding first light guide 8 via the rear face 80 then travel along inside this first light guide 8 toward the output interface 81, possibly by successive total internal reflections off the lower face 85, upper face 84 and lateral face 82.

The cross section of each first light guide 8 (which means to say the cross section transverse to the optical axis of the first light guide 8) here has a parallelogram overall shape, more precisely a rectangular shape. However, the cross section of each of the first light guides 8 could be of any shape. It could, for example, comprise curved sides. In any event, it is designed to produce the desired shape of light beam exiting the lighting module.

The output interfaces 81 of the first light guides 8, which in this instance are rectangular, constitute secondary light sources intended to produce respective beams of light exiting the lighting module. These beams of light have shapes that are rectangular overall in cross section (which means to say in section transversely to the optical axis $A_1$).

The first light guides 8 are juxtaposed and form, arranged at regular intervals, a horizontal row such that secondary light sources are created virtually in series on the rear face 60 of the correcting part 6, over substantially the objective focal surface of the projection system, so as to be projected to infinity in this segmented arrangement.

As can be seen in FIG. 2 in particular, the upper face 84 of each of the first light guides 8 is a curved surface with the overall shape of a cylindrical portion of substantially ellipsoidal generatrix. This has the effect of concentrating the light intensity in the upper part of the beam exiting each of the first light guides 8, which corresponds to a zone (referred to as "range zone") situated in the bottom of the matrix-style beam produced at output of the lighting module and which corresponds to the cutoff zone at the junction with the low beam produced at output from the optical module by interaction of the second primary light sources 2 and of the associated second light guide 9.

The lower faces 85 of the first light guides 8 are spreading faces configured to broaden the cross section of these first light guides 8, continuously, from their input face to their output face, each first light guide 8 widening at the bottom from its input to its output. The lower faces 85 here are curved and have a flared shape. As an alternative, they could be planar and inclined with respect to the longitudinal axis of the first light guides 8. The lower or bottom widening of each first light guide 8 allows a downward vertical spreading of the secondary light source 81 at the exit of the first light guide 8, which corresponds to an upward spreading of the corresponding region of the beam. Because of the shaping of the bottom of the first light guides 8, the top of each contiguous region is softened, the light intensity decreasing vertically upwards, progressively.

In FIG. 5, which illustrates in vertical and longitudinal section the primary optical element 3 and the associated first and second primary light sources 1, 2, it may be clearly seen that, as specified hereinabove, the second light guide 9 is positioned above the first light guides 8. This second light guide 9 will now be described in greater detail with reference once again to FIGS. 1 and 2.

The second light guide 9 is a single guide extending over substantially the entire transverse dimension of the primary optical element 3. Unlike each of the first light guides 8 which consist of a plurality of mutually independent guides which guide only the rays of light emitted by the light source associated with them, the second light guide 9 takes the form of a single strip of material that is continuous from one transverse side of the primary optical element 3 to the other.

The second light guide 9 comprises two vertical end faces one of which faces each of the first light guides 8 and a light input rear face 90 positioned facing a series of second primary light sources 2, the rear face 90 being opposite to a front output or output end or output interface 91, which acts as a secondary light source, connected to the correcting part 6.

It should be noted that in the embodiment illustrated, the light input rear face 90 has a transverse succession of convex shapes, in this instance taking the form of regular bosses 92, so that the rear face 90 of the second light guide 9 has a wavy shape. This wavy shape is oriented in such a way that the center of each boss 92 faces away from the correcting part 6, in the direction of rapprochement of the light sources. Each boss 92 is positioned facing one of the plurality of second primary light sources 2, these light sources 2 and the second light guide 9 being configured and mounted facing one another so that the optical axis of a second primary light source 2 is centered on the middle of one of the bosses 92. The bosses 92 are arranged in transverse series such that the end edges 93 of pairs of bosses 92 touch, and this then is a known way of defining a secondary input face 94 of this second primary optical means or second light guide 9, identified as being the surface connecting the end edges 93 of the bosses 92 to one another.

In other words, the second primary optical means or second light guide 9, which extends as an overhang above the first primary optical means or first light guides 8 can be defined as a succession of second primary optical means or second light guide 9 in a second direction, in this instance a transverse direction, and each second primary optical means or second light guide 9 can be considered to comprise a junction part 95 joining it to the correcting part 6 and an optical profile 96 installed at a free end of the junction part 95, on the opposite side to the correcting part 6, the junction parts 95 of the second primary optical means or second light guide 9 forming a common junction part extending continuously in the second direction.

As was seen earlier in the case of the arrangement of the light sources facing each of the first light guides 8, for each pair formed of a second primary light source 2 and of a boss 92 of the second light guide 9 associated therewith, the distance between an output plane of the light source and the input face of the associated second light guide 9 is between 0.1 millimeter and 1 millimeter.

The second light guides 9 and the second primary light sources 2 associated therewith, and positioned facing the bosses 92 of the input face, are configured so that the rays emitted by these light sources 2 enter the corresponding second light guide 9 via the rear face 90 then travel along inside this second light guide 9 toward the output face 91, possibly by successive total internal reflections off an upper face and a lower face 97, which faces toward the first light guides 8. It will be appreciated that, in the case of the second light guide 9, the rays emitted by a second primary light source 2 through one of the bosses 92 of the ray input rear face 90 may cross, between the secondary input face 94 and the output face 91, with the rays emitted by another second primary light source 2 through another of the bosses 92. In this way it is possible to create a beam that is more uniform horizontally because the secondary image created on the output face 91 of the second primary optical means or second light guide 9 and positioned in that way on the objective focal surface SF of the projection system is the result of a possible criss-crossing of beams emitted by different second primary light sources 2.

In FIG. 5, the lower face 97 of the second light guide 9 is a curved surface with the overall shape of a cylindrical portion, substantially in a mirror arrangement with respect to the upper face 94 of each of the first light guides 8. The effect of this is to concentrate the light intensity in the bottom part of the beam exiting the second light guide 9, which corresponds to a zone situated as close as possible to the cutoff at the exit of the lighting module. The spacing between the mutually-facing faces of the first and second light guides 8 and 9 also contributes to the ability to create a single component by molding to form the primary optical element 3, by creating a relief angle that is sufficient to allow the component to be demolded. Particular attention is paid to the curvature of this lower face 97 of the second light guide 9 and to the transverse line of contact between this lower face 97 of the second light guide 9, the rear face 60 of the correcting part 6, and the upper face 84 of the first light guides 8, because this line contributes to the creation of the cutoff of the beam.

In the particular example described here, the first light guides 8 are ten in number and the second light guide 9 on its input face 90 has six bosses 92. As a result of this there are ten first primary light sources 1 and six second primary light sources 2 arranged on the common support 5 facing the first and second light guides 8, 9. Of course, these numbers could vary, although they should preferably always be strictly greater than one, and these numbers could be equal so that as many independent first light guides 8 would be provided as there were bosses on the single second light guide 9.

In the context of a lighting module provided in a left or right vehicle headlight, and therefore where a beam of light generated by a left headlamp module is superposed on a beam of light generated by a right headlamp module, it is possible to design in a transverse offsetting of the independent first light guides 8 involved in the formation of contiguous regions of the beam, without however having to design in a transverse offset of the single second light guide 9. It will be appreciated that while the first and second light guides 8, 9 can be transversely offset relative to one another, their stepped or tiered arrangement one above the other remains the same.

FIGS. 5 and 6 show a feature of the invention relating to the position of the output faces of the various light guides 8, 9 with respect to the objective focal surface SF defined by the projection system formed by the correcting part 6 of the primary optical element 3 and by the secondary optical element 4. The output interfaces 81,91 of the first and second light guides 8 and 9 are positioned on this objective focal surface SF. Further, for reasons mentioned hereinabove, it is advantageous for the secondary input face 94, which means to say the curved surface that passes in succession through each of the end edges of the bosses 92, to be positioned upstream of the objective focal surface SF with respect to the direction of emission of light of the optical assembly formed by the sources and the primary optical element. The secondary input face 94, identified as being the surface connecting the end edges 93 of the bosses 92 one after the other, is defocused, and the resulting image of the secondary light source projected onto the focal surface SF, at the junction between the second primary optical means or second light guide 9 and the correcting part 6, is horizontally uniform because of the combining of the rays emitted by nearby light sources between the secondary input face 94 and the output face 91. This is a result of the design of the second primary optical means or second light guide 9 whereby, as was specified hereinabove, this means extends continuously between the secondary input face 94 and the output face 91.

Figure 3:
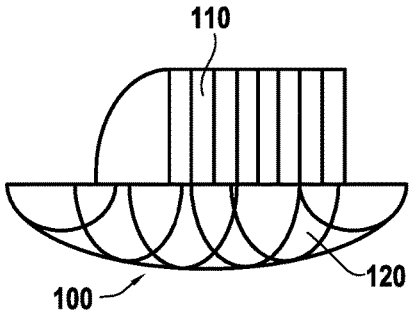
Figure 4:
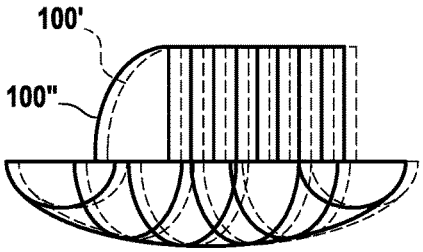

FIG. 3 depicts the beam of light 100 projected at the output of the lighting module. It is notably possible to distinguish segments of light 110 produced respectively by the secondary light sources 81 at the exit of each of the first light guides 8 and the broad beam 120 formed by the second primary light sources 2 and the associated second light guide 9. It will be appreciated that, in the case illustrated in the figures, switching on the second primary light sources 2 creates a low beam and switching on all of the first and second primary light sources 1 and 2 creates a high beam, with an upper part liable to dazzle users on the road scene, which upper part is in matrix form with contiguous regions, for example segments, that can be switched off selectively in order to avoid this dazzling. It may be understood, notably by reference to FIG. 3, that the creation of a matrix-form beam with each of the first light guides 8 that are separate and arranged in transverse series, generates a projection at infinity of contiguous regions and, for example, segments, which are very distinct. The presence of two modules in one and the same headlight may allow a small horizontal angular offset, in order to make this projected beam more uniform in this plane, as illustrated in FIG. 4, which illustrates the superposition of two beams 100' and 100" generated by two modules arranged in one and the same headlight, in this instance left headlight. It may be advantageous to have at least one lighting module as described in two headlights so that, by a transverse offsetting by a few degrees, a left beam of light and a right beam of light are superposed and also to superpose two broad beams just as well as two segmented beams, thereby obtaining a beam that is more dense and more uniform, as illustrated in FIG. 4.

With reference to FIGS. 1 and 2, the row of first light guides 8 comprises a left lateral end guide **8*j* and a right lateral end guide 8*a*, in the transverse direction. The left lateral end guide 8*j* is intended to produce a right lighting segment. Conversely, the right lateral end guide 8*a* is intended to produce a left lighting segment. The first left lateral end guide 8*j* may comprise a left lateral spreading face 82 configured to widen laterally and continuously the cross section of each of the first light guides 8 from its input face to its output. The left lateral spreading face 82 may be curved, widening from the input rear face 80 of the first left lateral end guide 8*j* as far as the output end 81 thereof. The lateral widening of the first left lateral end guide 8*j* allows a leftward lateral spreading of the secondary light source at the exit of the first left lateral end guide 8*j*, and which here corresponds to a lateral spreading to the right of the lighting segment produced as can be seen in FIG. 4. Because of the shaping of the left side of the first left lateral end guide 8*j***, the right-hand edge of the corresponding lighting segment is softened, the light intensity decreasing progressively laterally toward the right.

It will be emphasized that the lighting module depicted in FIGS. 1 and 2 is intended to be fitted to a motor vehicle left headlight and that FIGS. 3 and 4 correspond to beams created by modules in this left headlight. Further, it will be appreciated that the lighting module intended for a motor vehicle right headlight symmetrically comprises a first right lateral end light guide **8*a* that has a right-hand lateral face that widens in a similar way to the left lateral face of the first left lateral end guide 8*j* of FIG. 2**.

The rays of light transmitted via the light introduction part 7, having passed through the correcting part 6, travel toward the projection secondary optical element 4 and pass through the latter.

The role of the correcting part 6, in collaboration with each of the first light guides 8 and the second light guide, is a twofold role.

On the one hand, it makes it possible to improve the optical efficiency of the lighting module. The input of each of the first light guides 8 has the effect of reducing the aperture of the rays of light emitted by the first and second primary light sources 1 and 2, the rays entering the first and second light guides 8 and 9 being bent by the laws of refraction. Furthermore, at the interface between each of the first and second light guides 8,9 and the correcting part 6, the rays of light are not deflected because of the connection between each of the first light guides 8 and the correcting part 6. As a result of that, the smaller aperture of the rays is maintained. Finally, the rays of light exiting the correcting part 6 via the output face 61 are deflected little if at all by virtue of the spheroidal dome shape of the output face 61. Specifically, because the hemispherical correcting part 6 is centered on the junction at output of one of the first light guides 8 and of the second light guide 9, a ray emanating from the output plane of this first light guide 8 at the optical axis $A_1$ is normal or near-normal to the output face 61 and is therefore not deflected at the interface between the correcting part 6 and the surrounding air. A ray emanating from a zone offset from the optical axis is bent toward this optical axis. The refraction at the interface between the correcting part 6 and the surrounding environment (air) is in some way "compensated for" by the spherical or substantially spherical shape of the output face 61.

The correcting part 6 also makes it possible to correct for field aberrations of the optical system and thus ensure high quality imaging: the secondary optical element 4 here is a convergent optical lens having the axis $A_1$ as its optical axis. The distance separating the correcting part 6 and the secondary optical element 4 is strictly greater than zero and designed so that the plane in which the outputs of each of the first light guides 8 extend coincides substantially with the objective focal plane of the projection system formed by the secondary optical element 4 and by the primary optical element 3. As a result of that, the lighting module is suited to creating an image at infinity of the secondary light sources formed at the output ends of the guides. It thus possible to generate several lighting segments, with good imaging, using one and the same primary optical element 3 and light guides positioned on or away from the optical axis $A_1$. The half-ball that forms the correcting portion 6, by slightly modifying the orientation of the rays emitted by the outputs of the guides which are offset from the optical axis $A_1$, at the output interface 61, has a field-correcting effect.

The foregoing description clearly explains how the invention makes it possible to achieve its stated objectives and notably to propose a lighting device that makes it easier to design and manufacture a plurality of optical guides and install them in a module facing light sources in order to guide rays of light and create an adaptive beam.

The device according to the invention makes it possible to circumvent the variation in relative positioning of the light guides 8, 9 associated with a low-beam function and a high-beam function, by creating at least a series of these light guides 8,9 and the correcting part 6 associated with all of these light guides 8, 9 as a monoblock entity.

As specified hereinabove, it is particularly advantageous to associate with this correcting part 6 an arrangement of light guides 8, 9 that is particular in that two distinct types of guide, notably arranged differently with respect to the objective focal plane of the projection system formed by the output interface 61 of the correcting part 6 and by the secondary optical element 4 are superposed. The outputs of each of the first light guides 8 define the secondary images associated with these first light guides 8 and are positioned in the objective focal surface SF of the projection system, so that the beams exiting the projection secondary optical element 4 and corresponding to the rays emitted by the first primary light sources 1, which means to say the sources corresponding to the upper part of the high beam, are beams of parallel rays forming lighting segments of rectangular overall shape.

The second primary optical means 9 is itself arranged with respect to the objective focal surface SF of the projection system in such a way that the curve bearing the transverse ends of each of the patterns formed in series on the input face of each of the first light guides 8 is defocused, upstream of this objective focal surface.

It will be emphasized here that the lighting module of the invention exhibits excellent optical efficiency. The light flux emitted by the first and second primary light sources 1, 2 experiences little by way of losses in the correcting part 6 and is to a large extent recovered at the output of the module to create beams of light capable of forming lighting segments on the one hand for the complementary high beam and a broad overall beam for the low beam.

Furthermore, the lighting module may, using simple means and a correcting part 6 that is common to the first and second primary light sources 1, 2, produce lighting segments for the complementary high beam, the shapes of which are perfectly controlled and a low beam that is rendered horizontally uniform by the defocusing of the continuous strip of material that allows the spreading of the rays in the correcting part 6. It is possible to add patterns of the "modulations" or "microstructures" type to the surfaces of the secondary optical element 4 in order to deliberately add controlled cutoff fuzziness.

It will be appreciated that producing a primary optical element 3 bearing stepped or tiered light guides able to face series of distinct primary light sources 1, 2 makes it possible, using a single means, to perform a plurality of optical functions, including notably a DBL (Dynamic Bending Light) function or an AWL (Adverse Weather Light) function. One and/or the other of these functions is easily achieved by modulating the intensity of the light emitted by the primary light sources 1, 2 facing the light guides 8, 9. By way of example, it is possible, from right to left or from left to right depending on the direction of bend detected, progressively to increase the intensity of the light sources 1, 2 in order to increase visibility on one side of the overall beam of light and thus perform a DBL function. If the road is wet, it is possible to reduce the light intensity of the second primary light sources 2 which are close to the optical axis.

Of course, various modifications may be made by those skilled in the art without departing from the scope of the invention, it being understood that the invention should not be restricted to the embodiment specifically described in this document and that it extends in particular to any means that are equivalent and to any technically feasible combination of these means.

In particular, there follows an inexhaustive list of possible alternative forms that fall within the scope of the invention:

- it was described earlier that the primary light sources 1, 2 are mounted on one and the same support 5, thereby making it possible to limit the number of components in the light assembly. It will be appreciated that this support 5 may be planar, as illustrated in FIG. 5, or may have two parts inclined with respect to one another by an angle, if it is desirable for one series of primary light sources 1, 2 to emit parallel to the optical axis and for the other series of primary light sources 1, 2 to emit at a given angle with respect to the optical axis.
- as was described and illustrated, it is possible for the second light guide 9, positioned above the mutually independent first light guides 8 and formed of a single strip with curved light input faces, to be produced as a single piece with the correcting part 6, itself as a single piece with the first light guides 8, so as to form an entirely monoblock structure, or alternatively it is possible for the striplike second light guide 9 to be produced separately, it being understood that it is simple to produce by comparison with the multiple production of the first light guides 8, and that it can be mounted on the primary optical element 3 without any problem given that it extends over the entire transverse dimension of the primary optical element 3 and that it can therefore be fixed to the correcting part 6 outside of the zone of contact of the output faces of the light guides 8, 9 and of the rear face 60 of the correcting part 6 through which the rays of light pass. This embodiment may prove favorable, with a second light guide 9 attached to the correcting part 6 after it has been manufactured separately, in order to reduce the separation between the upper faces of the first light guides 8 and the lower face of the second light guide 9, this separation being rendered necessary in the case of a monoblock construction of the assembly in order to facilitate demolding.
- in the foregoing, it was specified that the input face of the second light guide 9, which extends continuously above the first light guides 8, was provided with successive bosses 92, each boss 92 being associated with one specific primary light source 1, 2. Provision may be made to have a strip of material at the input face that is substantially flat without bosses 92 when there is an associated primary light source 1, 2 that extends substantially across the entire transverse dimension of this second light guide 9.
- in the foregoing description, the projection optical element is a lens. As an alternative, the lens could be replaced by any other projection optical element capable of creating, at infinity, an image of the outputs of the light guides 8, 9. This projection element could comprise one or more lenses, one or more reflective mirrors, or alternatively, a combination of mirror(s) and of lens(es).

in the foregoing description, the projection element has the effect of inverting the output from the light guides 8, 9: the top of the secondary light source at the output of one of the light guides 8, 9 corresponds to the bottom of the beam produced at exit of the lighting module, and vice versa, and the right-hand zone of the secondary light source at the exit of one of the light guides 8, 9 corresponds to the left-hand zone of the beam produced at exit of the lighting module, and vice versa. In another form of embodiment, the projection element has no inverting effect. In that case, the shape of the light introduction part 7 and the shape of the correcting part 6 need to be adapted according to the shape desired for the beams of light at the output of the lighting module. The invention also relates to a motor vehicle headlight incorporating one or more lighting optical modules according to any one of the embodiments described.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A primary optical element for a motor vehicle lighting module, comprising:

a correcting part; and a light introduction part at a rear face of the primary optical element and connected at output to the correcting part, the light introduction part receiving light from first primary light sources and second primary light sources, wherein the light introduction part includes a plurality of first light guides which receives light from the first primary light sources, and a single second light guide which receives light from the second primary light sources and is arranged above the plurality of first light guides in a vertical direction, wherein the plurality of first light guides is arranged in series in a transverse direction substantially perpendicular to the vertical direction, each of the first light guides including a rear face which faces a corresponding one of the first primary light sources, a front output connected to the correcting part, first and second lateral faces, an upper face, and a lower face, wherein the single second light guide extends in the transverse direction and includes a rear face which faces the second primary light sources and a front output connected to the correcting part, the rear face of the single second light guide including bosses, each boss facing a corresponding one of the second primary light sources, and wherein the rear face of the first light guides extends further rearward along a longitudinal direction which is substantially perpendicular to the vertical direction and the transverse direction than the rear face of the single second light guide.

2. The primary optical element according to claim 1, wherein said front outputs of said plurality of first light guides and said single second light guide are positioned near an objective focal surface of a projection system comprising said correcting part.

3. The primary optical element according to claim 1, wherein said correcting part comprises an output face at least partially in a shape of a substantially spherical dome.

4. The primary optical element according to claim 1, wherein said plurality of first light guides and said correcting part form a monoblock structure.

5. The primary optical element according to claim 1, wherein respective refractive indices of said light introduction part and of said correcting part are substantially identical.

6. The primary optical element according to claim 1, wherein said light introduction part and said correcting part are manufactured from a same material.

7. An optical assembly comprising:

a primary optical element according to claim 1;

first primary light sources; and second primary light sources.

8. A lighting module for motor vehicle headlight, comprising:

a plurality of light sources;

a primary optical element according to claim 1; and an associated secondary optical element.

9. The primary optical element according to claim 1, wherein each boss includes a junction part making a junction with said correcting part and an optical profile installed at a free end of said junction part in order to form a light input face on an opposite side to said correcting part, said junction parts of said single second light guide forming a common junction part extending continuously in said transverse direction.

10. The primary optical element according to claim 1, wherein the single second light guide is formed on a protrusion of the primary optical element extending rearward in the longitudinal direction.

11. The primary optical element according to claim 2, wherein a secondary input face consists of a curved surface, passing in succession through each end edge of the bosses, and positioned upstream, with respect to a direction in which the light is emitted, of said objective focal surface.

12. The primary optical element according to claim 3, wherein said output face in the shape of a substantially spherical dome is centered substantially between said plurality of first light guides and said single second light guide.

13. The primary optical element according to claim 4, wherein said single second light guide forms a monoblock structure with said correcting part and said plurality of first light guides.

14. The optical assembly according to claim 7, wherein said first primary light sources and said second primary light sources are mounted on a support extending both opposite said plurality of first light guides and opposite said single second light guide.

15. The lighting module according to claim 8, wherein the front outputs of said plurality of first light guides are positioned near an objective focal surface of a projection system formed by said primary optical element and said secondary optical element, and the front output of said single second light guide is offset in the longitudinal direction with respect to said objective focal surface.

* * * * *